US009585523B1

(12) United States Patent
Brannan

(10) Patent No.: US 9,585,523 B1
(45) Date of Patent: Mar. 7, 2017

(54) DECORATIVE ATTACHMENT DEVICE

(71) Applicant: Ann B. Brannan, Webster Groves, MO (US)

(72) Inventor: Ann B. Brannan, Webster Groves, MO (US)

( * ) Notice: Subject to any disclaimer, the term of this patent is extended or adjusted under 35 U.S.C. 154(b) by 108 days.

(21) Appl. No.: 13/905,925

(22) Filed: May 30, 2013

Related U.S. Application Data

(60) Provisional application No. 61/689,163, filed on May 30, 2012.

(51) Int. Cl.
*A47K 1/14* (2006.01)

(52) U.S. Cl.
CPC ..... *A47K 1/14* (2013.01)

(58) Field of Classification Search
CPC .. E03C 1/2311; E03C 2001/2311; A47K 1/14
USPC ..... 4/295
See application file for complete search history.

(56) References Cited

U.S. PATENT DOCUMENTS

| | | | | | |
|---|---|---|---|---|---|
| 324,492 | A * | 8/1885 | Schwab | A47K 1/14 | 4/295 |
| 2,169,006 | A | 8/1939 | Nystrom | | |
| 2,619,654 | A * | 12/1952 | Coss | 241/32.5 | |
| 3,010,118 | A | 11/1961 | Isherwood | | |
| 3,414,949 | A | 12/1968 | Andrews | | |
| 3,481,155 | A | 12/1969 | Cook | | |
| D248,313 | S | 6/1978 | Henry | | |
| 4,692,948 | A * | 9/1987 | Martin | 4/286 | |
| 5,038,413 | A | 8/1991 | Ursino | | |
| 5,640,724 | A * | 6/1997 | Holmes | 4/689 | |
| 6,012,203 | A | 1/2000 | Pearson | | |
| 6,718,559 | B1 | 4/2004 | Davidson | | |
| 6,887,120 | B2 | 5/2005 | Shamitoff | | |
| 2006/0090257 | A1 | 5/2006 | Geller | | |
| 2011/0138527 | A1* | 6/2011 | Siena | 4/295 | |
| 2011/0225781 | A1 | 9/2011 | Cameron | | |
| 2013/0067693 | A1* | 3/2013 | Robinson | A41B 1/08 | 24/104 |
| 2013/0312177 | A1* | 11/2013 | Tong | E03C 1/2302 | 4/689 |

* cited by examiner

*Primary Examiner* — J. Casimer Jacyna
(74) *Attorney, Agent, or Firm* — Charles McCloskey

(57) ABSTRACT

A stopper has an elongated body and a cap that detaches from one end. The body has a seal proximate the cap for engaging a drain ring. The cap can have various decorations upon its upper surface such as logos, team mascots, and patterns applied by painting or waterproof durable adhesive label. The decorative attachment device has a cap that separates from the body with a male button within a chamber at the end of the body. The cap has a cooperating female button on its lower surface. Another embodiment has the cap separate from the body, hook and loop fastener, and a centered aperture. The cap has female loop fastener and a centered pin depending beneath the cap. The pin engages the aperture to align the cap to the body. Alternatively, the cap has a magnetic link to the body.

2 Claims, 9 Drawing Sheets

DECORATIVE ATTACHMENT DEVICE

CROSS-REFERENCE TO RELATED APPLICATION

This non-provisional application claims priority to the provisional application 61/689,163 filed on May 30, 2012 which is owned by the same inventor.

BACKGROUND OF THE INVENTION

The decorative attachment device generally relates to bathroom accoutrements and more specifically to a device upon a sink stopper visible to a user of the sink. More particularly, the invention attaches a two dimensional or a three dimensional decoration to the top of an existing sink stopper.

People use sinks in many places at work, at home, when travelling, and elsewhere. Sinks allow for delivery of water in a convenient location without the water running over the location, excepting a drain blockage. Sinks can be in a bathroom, a kitchen, a laundry room, a wet bar, an entertainment room, an entertainment area, and the like. In those locations, people may use water to perform various functions as commonly known.

Some sinks though may see less use than others. In homes, select bathrooms may remain in a heightened state of preparedness for guests or other visitors. In other homes, the homeowner may select a bathroom for heightened decoration because of personal preference. In other locations, the sink may see little use as people rarely visit the location. Public areas, such as hotels, convention centers, airport terminals, restaurants, and the like, also have sinks. These preceding sinks provide the opportunity for decorating each sink and its surroundings.

People enjoy many items as decorations. Painting and wall paper may decorate a room, such as a bathroom, to make it a bright and inviting place. Plants and sculptures break up the linear outlines in a bathroom and bring an element of the natural into the room. Even with those decorations, the humble sink retains its functional use for delivering and collecting water.

Over the years, sinks have received some decoration through coloration and pigments added to the constituents of the sink material. These forms of decoration occur at the time of manufacturing and remain through the life of the sink. Very rarely do people add decorations to a sink as those decorations must resist the intermittent or occasional use of the sink. At the bottom of the sink, the drain stands ready to release any collected water into the wastewater system. The drain may have a closure from a stopper as desired by the homeowner or other person using the sink. Most drains have their closures last for a short time or on an intermittent basis. Opening and closing a drain with a stopper involves raising and lowering the stopper using levers and pivoting rods as presently done. Because stoppers move and drains encounter water and other substances placed into them, decorating of drains and stoppers has lagged far behind the rest of the decorations in a bathroom or other setting.

DESCRIPTION OF THE PRIOR ART

Over the years, plumbers, metal fabricators, decorators, interior designers, and homeowners have sought to improve the look and appearance of sink stoppers. Sink stoppers and adjacent drains remain elusive in their willingness to accept decorations. Sink stoppers have a long history going back to at least the patent of Nystrom, U.S. Pat. No. 2,169,006. Nystrom shows an early drain fitting that serves as an ancestor of the common pop up stopper. The patent shows the stopper as valve 9 with its perpendicular flanges 10, 11, and cap 12. This fitting secures to the sink using a threaded nut 26 upon a threaded pipe casting. This patent shows a plain cap and vanes having rounded indentations.

The patent to Isherwood, U.S. Pat. No. 3,010,118 has a title including pop up sink stopper. However, the invention has a combination of a perforated disc at the sink bottom closed by an off-center weighted disc actuated by a rod. This patent shows a sink closed from beneath but not a cap resting in a flange as in modern stoppers.

The patent to Shames, U.S. Pat. No. D248,313 also has sink stopper in its title. The round stopper has a planar shape with a protrusion partially along one radius, shown like eastward.

The publication to Geller, No. 2006/0090257, provides a drain surrounding cover. The cover, 30, has a top, a bottom, an inner edge, and an outer edge. The inner edge has a diameter similar to the outer diameter of a drain ring 12 installed into a sink. The cover may have various designs, see FIGS. 6, 7, but also has an adhesive backing, see FIG. 4, for securement to the drain ring. As shown in FIG. 5, the cover protects the outer rim of a drain ring, and perhaps adjacent edges of the sink bottom. The cover though retains its center opening for passage of water but does not secure to a stopper.

Caps have connected to stoppers in various ways over the decades. Regarding means of connection, the publication to Cameron, No. 2011/0225781, shows a logo fastening system for paired clothing, such as socks. This system uses two clasps that mutually engage. Each clasp has a male portion and a female portion. The female portion has circular springs 54, 56 in FIG. 4, that fit around the male portion when inserted. This system uses a mechanical connection of one clasp portion.

The patent to Cook, U.S. Pat. No. 3,481,155 shows a necklace that can shorten into a compact wristband. FIG. 7 shows a male fastener 58 upon an article 24 for connecting to a female snap fastener 54. This fastening method allows the wearer to change articles as desired. This patent had its claims directed to the compactable chain and holder with eyes, or loops, 48, shown in FIG. 3.

The patent to Andrews, U.S. Pat. No. 3,414,949 provides a snap fastener for clothing that also receives an ornamental button. This snap fastener has a female element 6 that receives an attaching element 11 for securement to clothing. The attaching element then itself receives the connector member 17 through the clothing. The button 23 then fits upon the attaching element but removes readily as desired. This patent shows a snap fastener used to secure one item to another but also supporting components in the garment adornment area.

The toys shown in the Shamitoff patent, U.S. Pat. No. 6,887,120, have parts and appendages connected to a main body by male and female snap portions. Upon detaching a male portion from a female portion, the toy emits a snap sound. FIG. 3 shows the snap portions in more detail where the male portion 126 has a lip upon the top of the annular wall 130. The male snap portion appears again in FIG. 13 with the lip shown more clearly. The patent specifies the annular wall having a depth matching the depth of the recess 134 in the female portion.

From the world of motorcycles, Davidson's U.S. Pat. No. 6,718,559 shows snap-on decorative devices for helmets. The devices use male and female snaps shown in FIGS. 3, 11. FIG. 5 shows the connection of a decoration 20 to the helmet 22 with a section view of the snap. The female snap has an annular ring between two concentric walls, each wall having a rounded end outwardly from the decoration, that is, a protuberance.

Pearson's U.S. Pat. No. 6,012,203 illustrates attaching adornments to fashion items. This patent uses a decorative element fitted upon a stud and then secured into the socket. The claims refer to an eyelet with prongs bent upon the decorative element shown in FIGS. 2, 4, and 11-13.

Also from the fashion world, Ursino's U.S. Pat. No. 5,038,413 provides a means of fastening socks where one sock has a first fastener and the other sock has a second fastener. The first fastener has a pin, 13, that engages a hole in round part 23 of the second fastener. This connection appears in section view in FIG. 4.

Though the prior art includes various connectors, the prior art has shown few instances of connecting two or three dimensional objects to a sink stopper. The present invention overcomes the disadvantages of the prior art and provides a decorative attachment device that connects a two or three dimensional object to a sink stopper to suit the aesthetic and decorating preferences of a homeowner. The present invention provides a device that connects to an existing stopper body using minimal skill. The present invention accomplishes its goal of connecting a decorative object to a sink stopper using a variety of way.

SUMMARY OF THE INVENTION

Generally, the decorative attachment device has an elongated body with vanes and flange, and a cap that detaches from one end of the body. The body has a seal proximate the cap for engaging a drain ring or the sink bowl. The cap can have various decorations upon its upper surface such as logos, team mascots, color patterns, and the like applied by painting or waterproof durable adhesive label. In one embodiment, the cap separates from the body with a male button, or snap, within a chamber at the end of the body. The cap has a cooperating female snap or button on its lower surface. Another embodiment shows the cap separate from the body where the body has a plate upon one end opposite the flange that receives male hook and loop fastener and has a centered aperture. The cap has female hook and loop fastener upon its lower surface and a centered pin depending beneath the cap. The pin engages the aperture to align the cap to the body.

There has thus been outlined, rather broadly, the more important features of the invention in order that the detailed description thereof that follows may be better understood and that the present contribution to the art may be better appreciated. The present invention also includes more features of the invention not described in the summary such as a threaded pin for embedding into the body of a stopper, a separate cap with a threaded screw for embedment into an existing stopper cap, and a separate cap with internal threads that embed upon the edge of an existing stopper cap. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a decorative attachment device that secures to the top of a sink stopper.

Another object is to provide such a decorative attachment device that releases from the top of a sink stopper without any permanent residue upon the stopper.

Another object is to provide such a decorative attachment device that supports both two and three dimensional decorations above a sink stopper.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
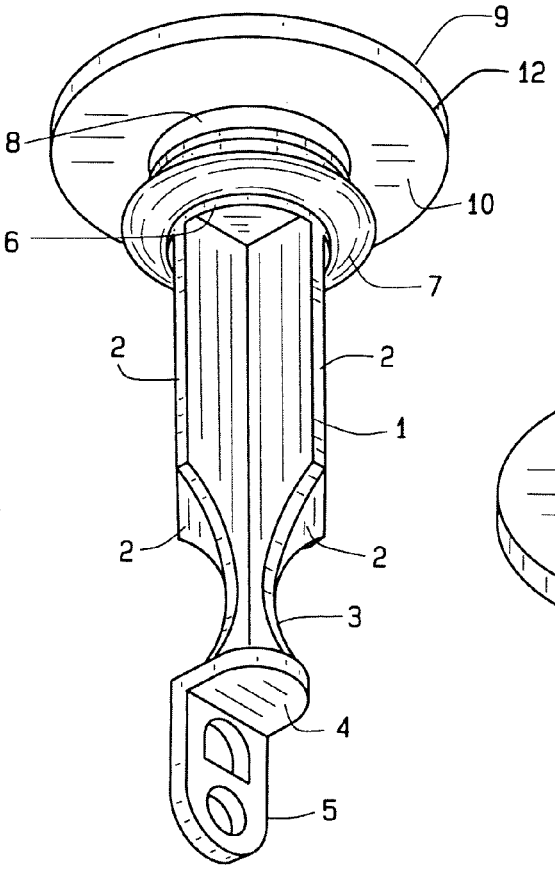
FIG. 1 provides an isometric view of an existing stopper.

The present art overcomes the prior art limitations by providing a decorative attachment device for improving the appearance a sink, typically in a bathroom but not always. A sink stopper has the classic form shown in FIG. 1. A prior art sink stopper appears cleanly in FIG. 1 though when viewed beneath a cabinet, a sink stopper may have a more difficult appearance to a homeowner attempting to connect or to remove the lifting rod. A stopper may also have the name of a pop-up stopper. Upon removing the lifting rod, the sink stopper removes from the drain and appears as in FIG. 1. The sink stopper has a body 1, generally elongated that has four orthogonal vanes 2 upon a common axial centerline. The vanes have a length generally greater than the width of the body. Each vane has two ends and upon one end tapers then curves inwardly to a lesser width, forming a neck 3. The necks of the vanes allow for passage of fluids past them and for passage of air through the overflow tube that opens in the sink drain proximate the neck when installed. The necks then flare outwardly somewhat to a generally planar shoulder 4 also perpendicular to the vanes. The shoulder may have many forms, here though the shoulder has a planar form in the shape of a letter D with a curved edge and an opposite straight edge forming a partial semicircle. Upon the straight edge, a flange 5 depends perpendicular to the shoulder and generally offset from one or more vanes. The flange has an elongated shape with at least one aperture therein for admission of a rod, (not shown) that connects to the lifting mechanism of the sink.

On the other end of the vanes, the vanes merge perpendicularly into a plate 6 that has a generally round shape with a diameter approximately twice that of the width of a vane. The width of two vanes is generally not much less than the inside diameter of the drain in a sink. The width of two vanes prevents the sink stopper from wobbling side to side along two axes when installed. Above the plate, the stopper has an annular seal 7 that has an inner diameter slightly smaller than the outer diameter of the plate. This inner diameter allows for a snug fit of the seal to the plate. The outer diameter of the seal exceeds that of the plate and is slightly more than the diameter of the drain. The seal is a flexible material that compresses under the weight of the stopper. Above the seal, the stopper has a wall 8 generally round in shape as viewed from above with an outer diameter slightly less than that of the seal. The wall has a height greater than that of the seal. Outwardly from the wall, the stopper has its cap 9 that secures to the wall. The cap often has a pivotal connection to the wall so that the cap may rotate about an axis upon the centerline of the stopper. The cap has a diameter greater than the wall and the seal but generally no more than the diameter of the drain opening at the bottom of a sink. The cap generally fits snugly in the drain opening. The cap has a lower surface 10 generally flat and towards the stopper body and an opposite upper surface 11 generally slightly spherical. The curvature of the upper surface aids in shedding water that falls thereon. The cap has its rim 12 that connects the lower surface to the upper surface. The rim has a round shape making the cap have a generally round form that matches the round drain openings common in sinks.

Figure 2:
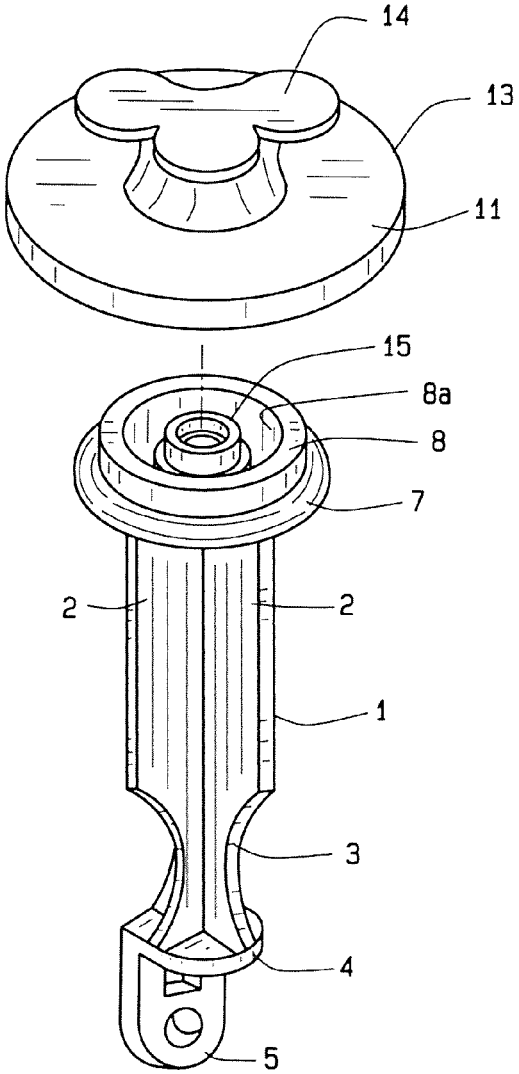
FIG. 2 shows a partially exploded view for a snap embodiment of the invention.

Having described the prior art stoppers, FIG. 2 shows the present invention with its separate cap 13 that has a decoration such as a three dimensional sculpture as at 14. The decoration upon the cap may take many forms subject to artistic or aesthetic taste. This separate cap 13 has a generally round, thin shape as shown with an upper surface 11 and an opposite lower surface 10. The upper surface has the decoration. The decoration may be manufactured with the cap as a single piece or alternatively, the decoration or sculpture connects to the cap. The lower surface then links, or connects, the cap and decoration to an existing stopper body 1, or pop up stopper, using mechanisms as later described. This stopper body has the vanes 2, neck 3, shoulder 4, flange 5, plate 6, seal 7, and wall 8 as in FIG. 1. For this embodiment of the invention, the stopper body has the wall, generally round, forming a chamber 8*a* interiorly of the wall and generally upon the plate. The chamber has a depth generally parallel to the length of the stopper body. The depth has its height at least that of surrounding wall 8. The chamber has a diameter of at least one width of a vane 2. The chamber receives a male button 15 that connects to the plate and has an orientation opposite to the vanes. The button has a generally cylindrical shape with its own top surface, generally concave. Opposite its top surface, the button expands outwardly with its flange having a greater diameter than the remainder of the button. The center of the top surface allows for the button to connect to the body 1 using a mechanical connection, a welded connection, or an adhesive and the like.

Figure 3:
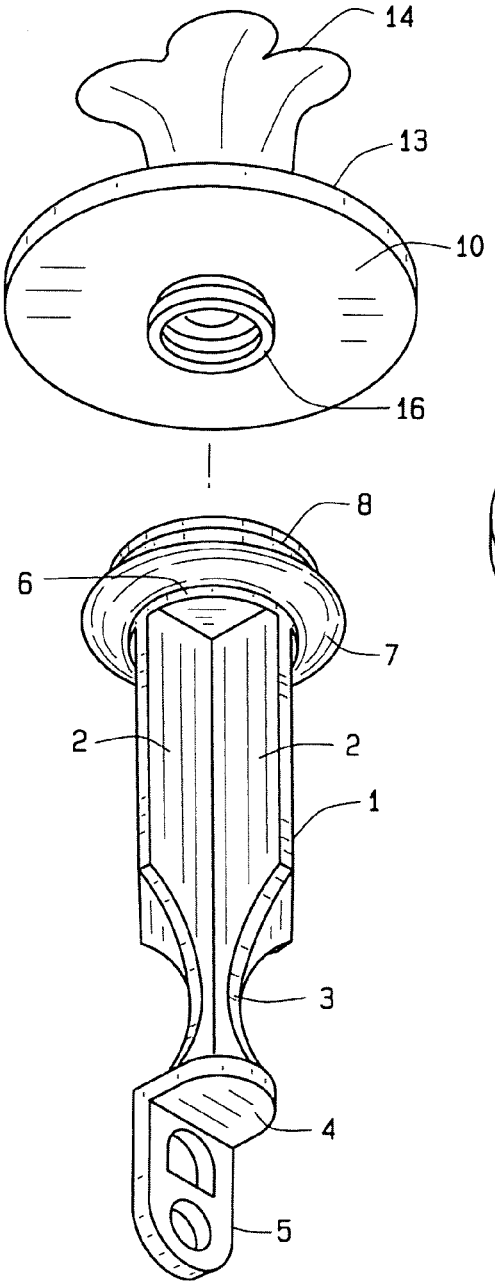
FIG. 3 illustrates a bottom view, opposite FIG. 2 for the snap embodiment.

With a male button deployed upon the body 1, FIG. 3 shows the cap 13 prepared for its connection to the rest of the body in this embodiment. The cap has its lower surface 10 opposite the upper surface that has the decoration 14. The lower surface has a generally flat orientation so that it extends perpendicular to the centerline of the body. The lower surface also receives a female button 16 upon its center. The female button has a generally hollow, cylindrical shape with its closed top. The closed top connects the female button to the lower surface generally using a mechanical connection, a welded connection, an adhesive and the like. The female button has an inside diameter slightly larger than the diameter of the upper surface of the male button. Upon placing the male button into the female button, the cap 13 secures to the stopper body 1.

Figure 4:
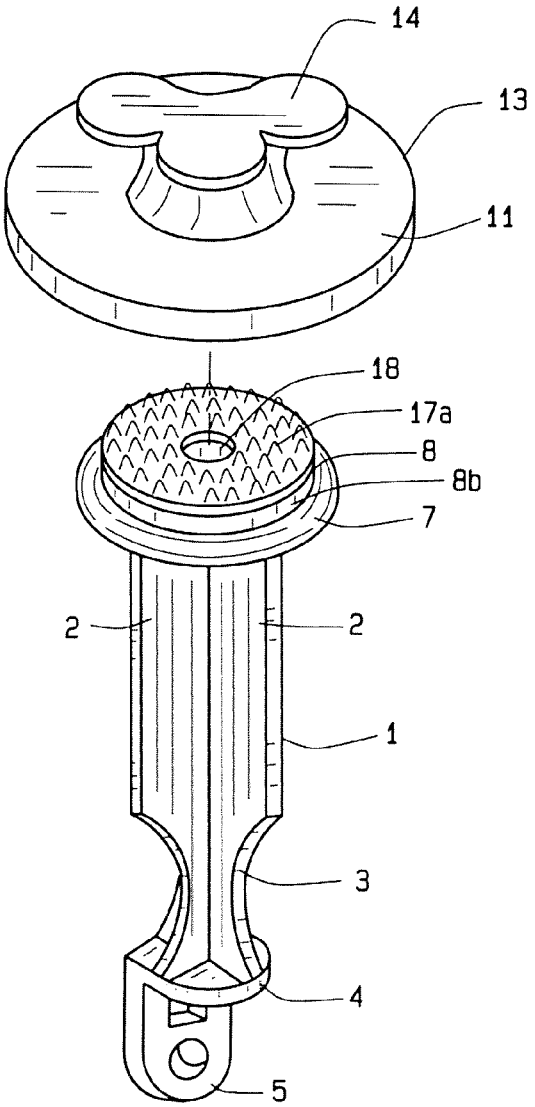
FIG. 4 shows a partially exploded view for a releasable fastener embodiment of the invention.

FIG. 4 shows another means to connect the separate cap 13 having its decoration, such as a three dimensional sculpture as at 14. As above, the decoration upon the cap may take many forms. This separate cap 13, round and thin, has its upper surface 11 with the decoration and an opposite lower surface 10. Cap may have integral construction, molding, or casting with the decoration or the cap may have separate component construction with the decoration. The lower surface then connects the cap and decoration to an existing stopper body 1 as later shown, or to a pop-up stopper. This stopper body has the vanes 2, neck 3, shoulder 4, flange 5, plate 6, seal 7, and wall 8 as in FIG. 1. For this embodiment of the invention, the stopper body has the wall, generally round, forming a solid disk like shape of similar diameter to the plate 6 and less diameter than the seal 7. The wall has a generally constant height across the plate which produces a flat surface 8*a* that receives a portion of releasable fastener such as hook and loop. The wall has one portion of the fastener 17*a*, preferably the loop portion. The portion 17*a* generally has the same diameter as that of the wall for a smooth finish upon the exterior rim of the wall. The portion 17*a* includes an aperture 18 that extends through the portion of releasable fastener and into the wall 8. The aperture has a generally round, hollow shape and a depth at least half way into the wall thickness.

Figure 5:
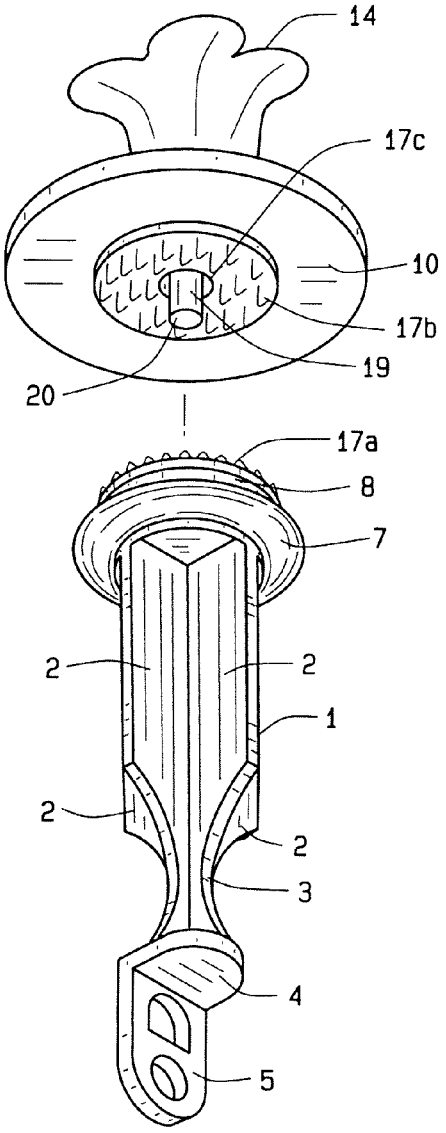
FIG. 5 illustrates a bottom view, opposite FIG. 4 for the releasable fastener embodiment.

With the aperture 18 upon the wall 8 of the body 1, FIG. 5 shows the cap 13 prepared for its connection to the rest of the body in this embodiment. The cap has its lower surface 10 opposite the upper surface that has the decoration 14. The lower surface has a generally flat orientation so that it extends perpendicular to the centerline of the body. The lower surface also has a pin 19 extending opposite from the upper surface 11, or the decoration 14. The pin has a generally cylindrical shape with a diameter less than that of the cap and preferably slightly less than that of the aperture 18. The pin has a rounded over tip 20 where the rounded over assists during placement of the tip into the aperture. The lower surface also includes another portion 17*b* of releasable fastener, preferably the hook portion. This portion 17*b* generally has the same diameter as that of portion 17*a*, the hook portion, for a smooth finish upon the exterior rim of the wall. This portion 17*b* includes its aperture 17*c* that admits the pin. Upon placing the pin 19 into the aperture 18, the loop portion, as at 17*b*, cooperates with the hook portion, as at 17*a*, so that the cap secures to the stopper body 1 until a homeowner desires to change the cap and its decoration.

Figure 6:
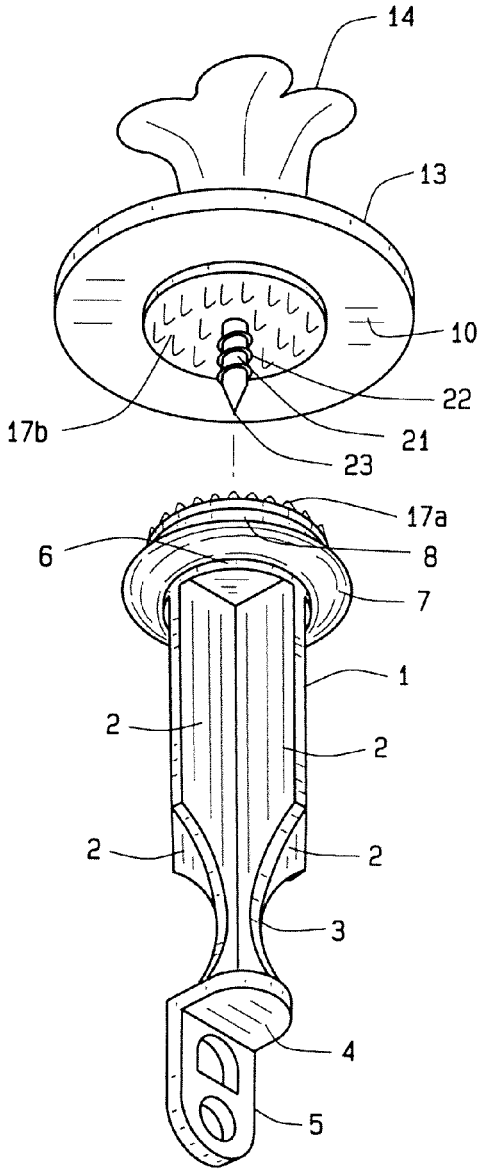
FIG. 6 provides a bottom exploded view for a self drilling tip embodiment of the invention.

With the aperture 18 upon the wall 8 of the body 1, FIG. 6 provides an alternate form of the cap 13 prepared for its connection to the rest of the body. The cap has its lower surface 10 opposite the upper surface with the decoration 14. The generally flat, lower surface extends perpendicular to the centerline of the body. The lower surface also has a pin 21 extending opposite from the upper surface 11, or the decoration 14. This pin has a generally cylindrical shape with a diameter less than that of the cap. This has the form of a screw with fine threading, as at 22, upon at least half of its length outwardly from the lower surface. The pin has a self drilling tip 23 suitable for excavating a chamber into the stopper body. The tip 23 is a width slightly less than the diameter of the threads. The tip excavates most of the material for an aperture to receive the rest of the tip but leaves material for the threading to grip. Optionally, the lower surface includes a portion 17*b* of the releasable fastener while the wall 8 has the other portion 17*a* as previously described.

Figure 7:
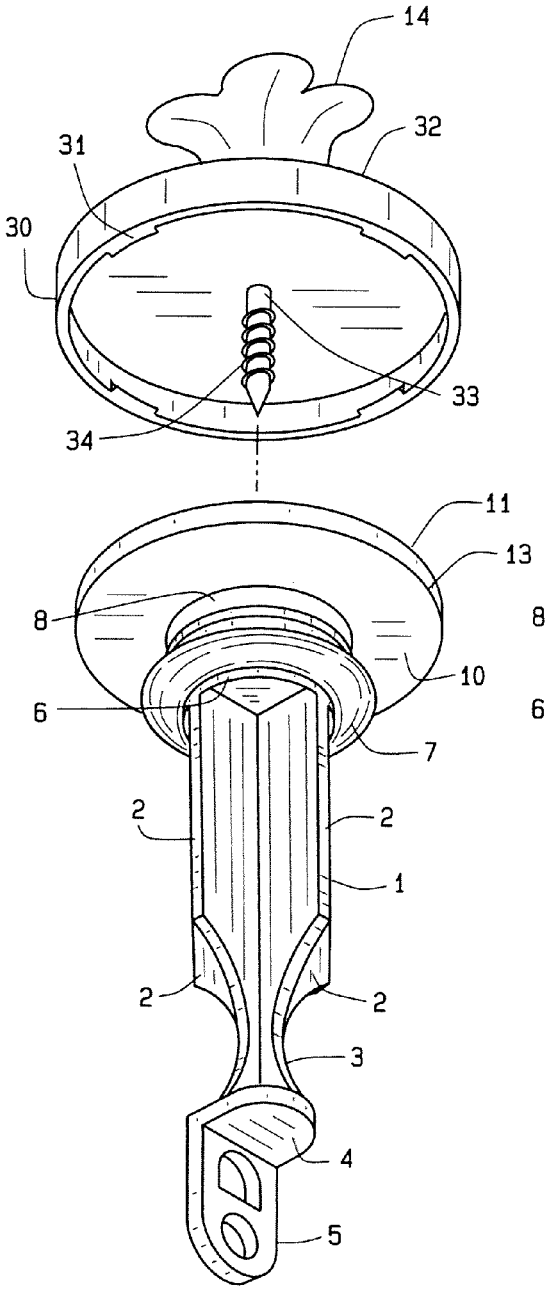
FIG. 7 describes a bottom view of an embodiment with a screw tip beneath a cover.

As the present invention attaches to an existing stopper or pop up stopper, FIG. 7 describes another alternate embodiment of the invention. The stopper body 1 has its components as previously described. The body has its cap 13 denoting the top of the stopper and users usually view the cap when installed in a sink. The cap has its upper surface 11 often partially concave to ease drainage of water. The upper surface may have metallic construction, plated construction, a metallic film upon a plastic substrate, and the like. The invention's alternate embodiment includes a cover 30, generally round in shape with a wall 31 upon the perimeter of the cover. The cover also has its upper surface 32 upon which joins the decoration 14. The wall depends perpendicular and below the upper surface. The cover 30 has an inside diameter of the wall slightly greater than the diameter of the upper surface 11 of an existing cap. During installation, the wall slips over the edge of existing cap and the cover rests upon the upper surface 11 of the existing cap. For additional securement of the cover 30, the cover includes a screw 33 having coarse threading 34. The screw joins to the cover in a connection that resists rotation as during installation. The screw penetrates the cap 13 of an existing stopper and the threading 34 then embeds the screw into the body 1. A user turns the cover so that the screw engages the cap and advances into the body so that the cover has a snug fit upon the cap. Upon select sinks, the drain has a perforated plate. This alternate embodiment with its screw 33 can utilize the screw to attach the cover 30 to an aperture in a perforated plate and have the decoration 14 extend upwardly from the so-decorated plate.

Figure 8:
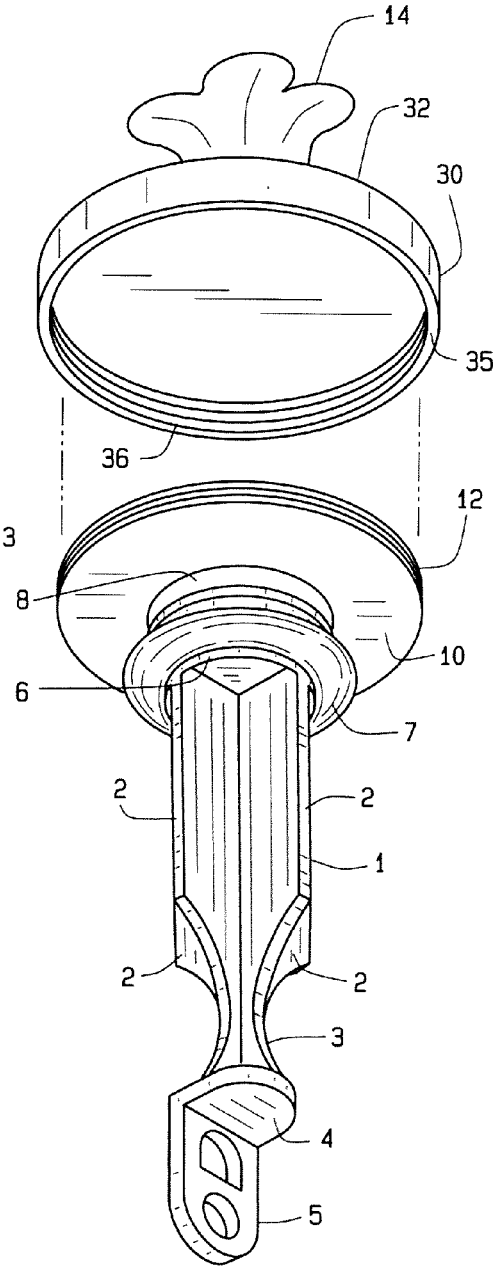
FIG. 8 illustrates a bottom view of an embodiment with a cover having a threaded lip.

FIG. 8 illustrates another alternate embodiment of the invention. The stopper body 1 has its components as above and its cap 13 denoting the top of the stopper, usually seen when installed in a sink. The cap has its upper surface 11 often partially concave to ease drainage of water. The upper surface may have metallic construction, plated construction, a metallic film upon a plastic substrate, and the like. The invention's alternate embodiment includes a cover 30, generally round in shape with a lip 35 upon the perimeter of the cover. The cover also has its upper surface 32 upon which joins the decoration 14. The lip depends perpendicular and below the upper surface. The lip 35 has an inside diameter slightly greater than the diameter of the upper surface 11 of an existing cap. During installation, the lip approaches the edge of existing cap and the cover then rests upon the upper surface 11 of the existing cap. For additional securement of the cover 32, the lip includes intermittent internal threads 36. The internal threads have gaps between sections of thread. The gaps allow for placement of the lip upon the edge of the cap. The gaps also permit removal of excess material incised from the edge of the cap during installation. With this alternate embodiment, the user grips the lip and places the edge of the lip opposite the upper surface 32. The user then rotates the lip and the cover, typically clockwise, that is, using right hand threads, so that the threads incise and bind into the edge of the cap. The applicant foresees rotating the cover approximately 60 to 180 degrees for full embedment of the threads 36 into the cover. Alternatively, this cover includes a threaded screw 34 depending beneath the upper surface as shown. As a further alternative, the cover 32 secures to the existing cap using a bayonet lock. The cover 30 receives a decoration 14 attached to it using welding, soldering, magnetism, hook and loop fasteners and the like.

Figure 9:
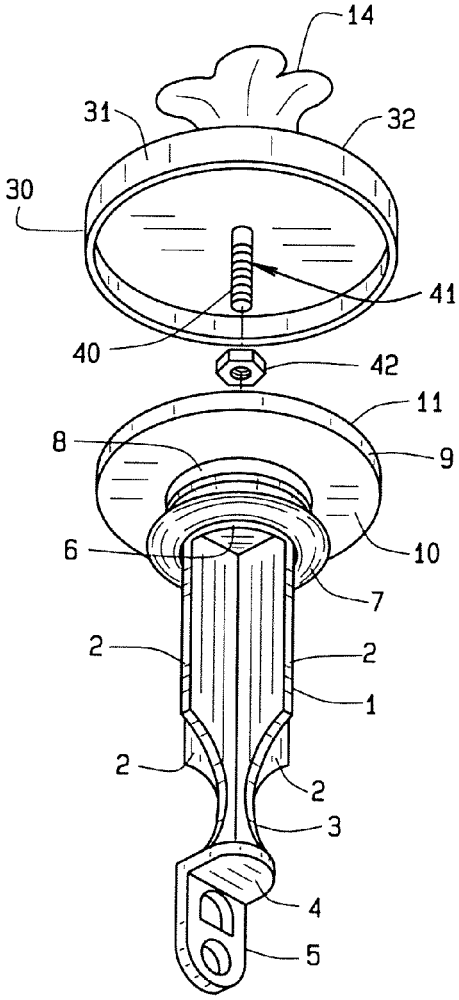
FIG. 9 describes an exploded bottom view of an alternate embodiment with a machine screw beneath a cover.

FIG. 9 illustrates another alternate embodiment of the invention similar to FIG. 8. The stopper body 1, or pop-up stopper, has its components as above and its cap 9 denoting the top of the stopper, usually seen when installed in a sink. The cap has its upper surface 11 often partially concave to ease drainage of water. The upper surface may have metallic construction, plated construction, a metallic film upon a plastic substrate, and the like. The existing cap may be non-magnetic, ferrous, or magnetic. The invention's alternate embodiment includes the round cover 30, that optionally has the lip 35 upon the cover's perimeter. The cover also has its upper surface 32 upon which joins to the decoration 14. The lip excludes threads and threading as in the prior alternate embodiment. This embodiment of the invention has a machine screw 40, or bolt, depending from and centered beneath the cover. The machine screw 40, or bolt, has its fine threading as at 41 engage a threaded nut 42. The threaded nut has cooperative threading that mesh with the threading of the machine screw. The threaded nut 42 embeds into the upper surface 11 of the cover 13 as later shown. Though FIG. 9 shows a lip 35, the Applicant foresees embodiments having a cover without a lip.

Figure 10:
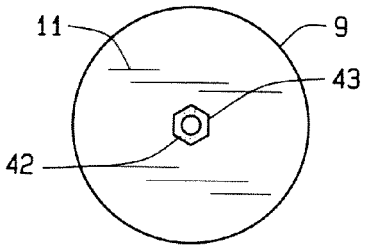
FIG. 10 is a top view of the stopper in the alternate embodiment of FIG. 9.

FIG. 10 shows a top view of the stopper, or pop-up stopper, for the alternate embodiment introduced in FIG. 9.

The cap 9 has its upper surface 11 and a shaped recess 43 to receive the threaded nut, or recess of a width slightly less than the width of the threaded nut 42. The shaped recess or slightly narrow recess grips the nut 42 to prevent it rotating and slipping in the upper surface 11 so that the bolt, or machine screw 40, has a snug fit into it. includes a threaded screw 34 depending beneath the upper surface as shown. With this alternate embodiment, the user grips the cover 30 and places a tip 44 of the machine screw 40 into the nut 42. The user then rotates the cover, typically clockwise, that is, using right hand threading for the machine screw and nut, so that the screw 40 advances into the nut 42 and the cover secures upon the stopper. The Applicant foresees rotating the cover approximately up to 5 rotations for full embedment of the screw into the nut and the cover upon the stopper. As before, the cover 30 receives a decoration 14 attached to it using welding, soldering, magnetism, hook and loop fasteners and the like.

Figure 11:
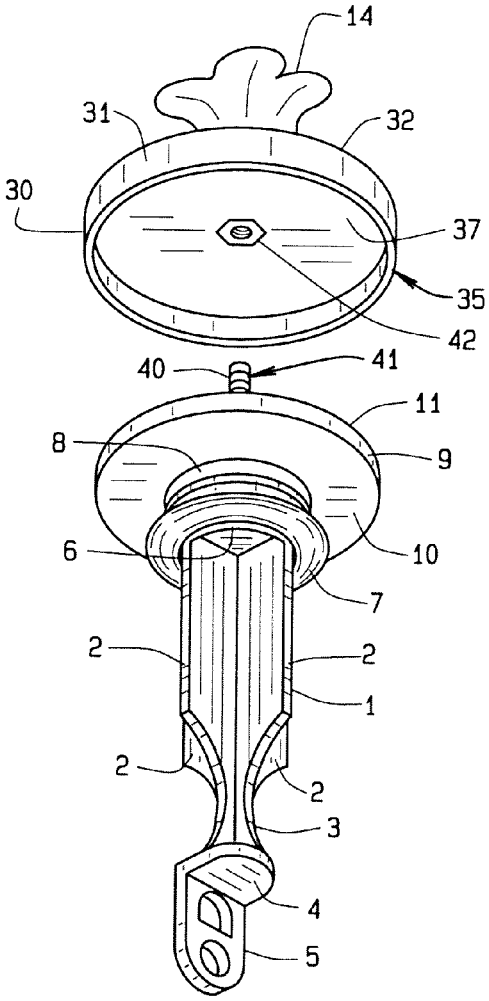
FIG. 11 describes an exploded bottom view of an alternate embodiment with a machine screw extending from the stopper.

FIG. 11 illustrates another alternate embodiment of the invention similar to FIG. 9. The stopper body 1 has its components, and its cap 9 denoting the top of the stopper, usually seen when installed in a sink. The cap has its upper surface 11 often partially concave to ease drainage of water. The upper surface may have metallic construction, plated construction, a metallic film upon a plastic substrate, and the like. The existing cap may be non-magnetic, ferrous, or magnetic. The invention's alternate embodiment includes the round cover 30, that optionally has the lip 35 upon the cover's perimeter. The cover also has its upper surface 32 upon which joins to the decoration 14 and a lower surface 37 shown here and generally opposite the upper surface. The lip excludes threads and threading as in the prior alternate embodiment. This embodiment of the invention has the bolt, or machine screw 40, extending perpendicular from and centered upon the top surface 11 of the cap 9 of the stopper. The machine screw 40 has its fine threading as at 41 that engages a threaded nut 42. The threaded nut has cooperative threading that meshes with the threading of the machine screw. The threaded nut 42 embeds into the lower surface 37 of the cover 30 as later shown. Though FIG. 11 shows a lip 35, the Applicant foresees embodiments having a cover without a lip. This figure also applies to a pop-up stopper.

Figure 12:
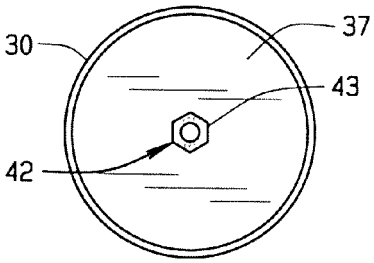
FIG. 12 is a bottom view of the cover in the alternate embodiment of FIG. 11.

FIG. 12 shows a bottom view of the cover 30 stopper for the alternate embodiment introduced in FIG. 10. The cover 30 has its lower surface 37 and a shaped recess 43 to receive the threaded nut, or recess of a width slightly less than the width of the threaded nut 42. The shaped recess or slightly narrow recess grips the nut 42 to prevent it rotating and slipping in the upper surface 11 so that the machine screw 40, or bolt, has a snug fit into it. With this alternate embodiment, the user grips the cover 30 and places the nut 42 upon the machine screw 40. The user then rotates the cover, typically clockwise, that is, using right hand threading for the machine screw and nut, so that the nut 42 advances upon the bolt and the cover secures upon the stopper. The Applicant foresees rotating the cover approximately up to 5 rotations for full embedment of the screw into the nut and the cover upon the stopper, or pop-up stopper. As before, the cover 30 receives a decoration 14 attached to it using welding, soldering, magnetism, hook and loop fasteners and the like.

Figure 13:
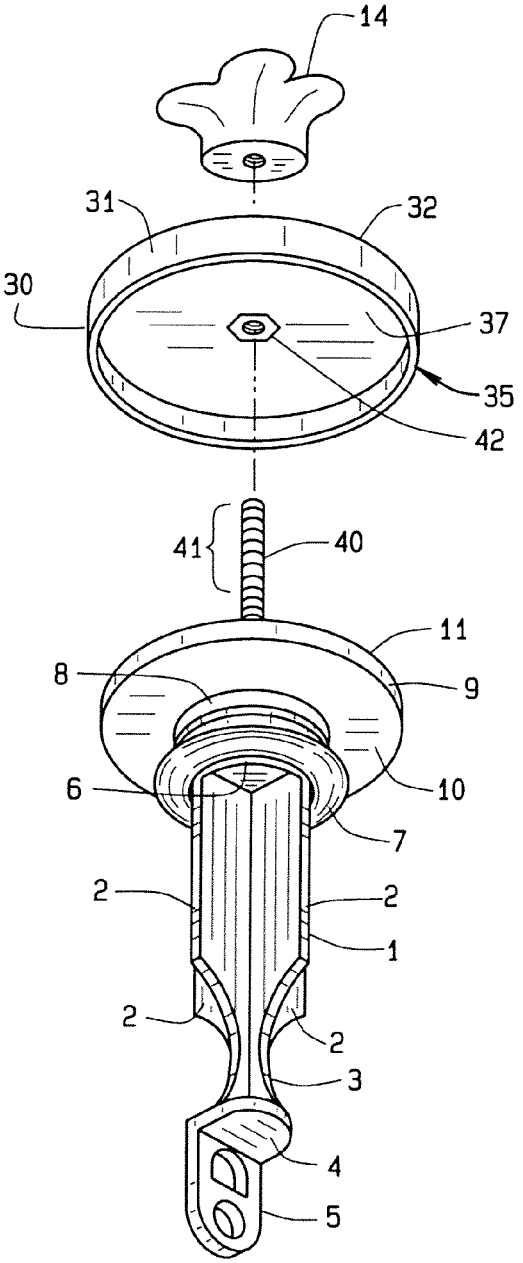
FIG. 13 describes an exploded bottom view of an alternate embodiment with a machine screw extending through the cover and into the decoration as shown.

FIG. 13 illustrates another alternate embodiment of the invention similar to FIG. 11. The stopper body 1 has its components and its cap 9 usually seen in a sink. The cap has its upper surface 11 often partially concave to ease drainage of water. The upper surface may have metallic construction, plated construction, a metallic film upon a plastic substrate, and the like. The existing cap may be non-magnetic, ferrous, or magnetic. The invention's alternate embodiment includes the round cover 30, that optionally has the lip 35 upon the cover's perimeter. The cover also has its upper surface 32 upon which joins to the decoration 14 and a lower surface 37 shown here and generally opposite the upper surface. The lip excludes threads and threading as in the prior alternate embodiment. This embodiment of the invention has the bolt or machine screw 40, extending perpendicular from and centered upon the top surface 11 of the cap 9 of the stopper. The machine screw 40 has its fine threading as at 41 that engages a threaded nut 42. This embodiment has a longer machine screw than that shown in FIG. 11. This machine screw extends from the stopper, through the nut 42, and into the decoration 14. The threaded nut, in the cover, has cooperative threading that meshes with the threading of the machine screw. The threaded nut 42 embeds into the lower surface 37 of the cover 30 and allows the machine screw to pass completely through the nut. Though FIG. 11 shows a lip 35, the Applicant foresees embodiments having a cover without a lip.

Alternatively, the cover 30 includes the recess 43 centered therein that allows passage of the machine screw through the cover for securement into a threaded connection with the decoration. This further alternative holds the cover in place upon the stopper using compression and friction between the decoration and the upper surface 11 of the cap.

Figure 14:
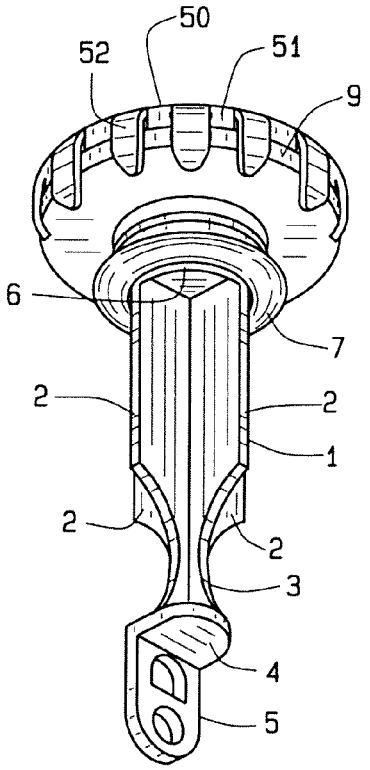
FIG. 14 shows a side view of an alternate embodiment with a cover upon the cap of a stopper.

FIG. 14 shows a side view of another alternate embodiment having a cover 50 that secures upon a stopper 1. The cover has a generally round shape that cooperates with the upper surface 11 of the cap 9 of an existing stopper, or pop-up stopper. The stopper has its vanes 2, neck 3, shoulder 4, flange 5, plate 6, and seal 7 as before. Above the seal, the stopper has the cap 9 with its upper surface concealed beneath the cover 50. The cover 50 has a perimeter 51 and a plurality of tabs 52 regularly spaced upon the perimeter. Each tab has an elongated, generally planar, shape narrowing outwardly from the cover. During use of this embodiment, a user places the cover 50 adjacent to the upper surface and then gently folds the tabs upon the perimeter of the cap. The friction between the tabs and the cap keeps the cover in place. The tabs allow for bending beneath the cap and towards the seal and the plate.

Figure 15:
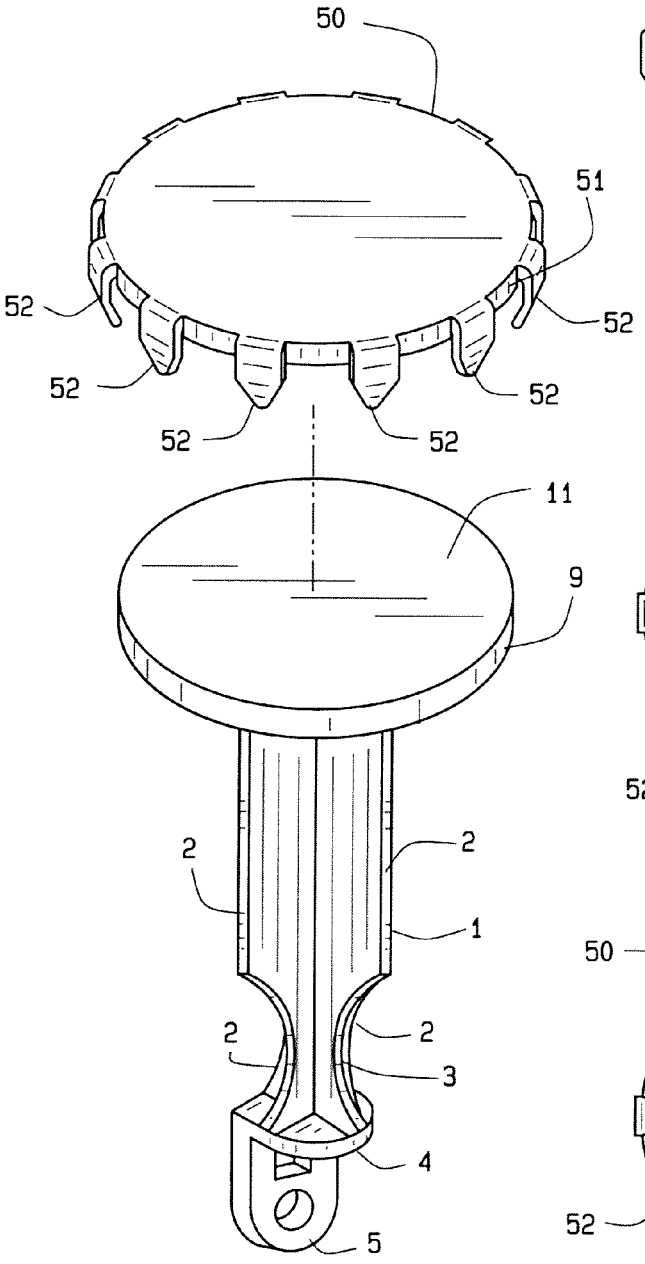
FIG. 15 describes an exploded bottom view of the alternate embodiment of FIG. 14.

FIG. 15 shows an exploded view of this alternate embodiment akin to what a user would see prior to installation of the cover 50. The cover is generally round in shape to cooperatively fit upon the cap 9 of the stopper or pop-up stopper. The tabs are at least three in number but may be provided in a greater number to achieve more frictional hold upon the cap. The tabs have a length generally more than the thickness of the cap.

Figure 16:
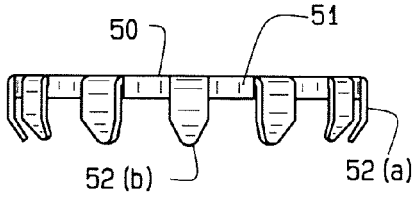
FIG. 16 is a side view of the cover of the alternate embodiment of FIG. 14.

Looking at the cover itself, FIG. 16 shows a side view of the cover 50 with its tabs 52 depending from the perimeter 51. Towards the right of the figure, an exemplary tab is shown on edge, as at 52(*a*). The tabs have a thin cross section so a user can bend them with her fingers. Towards the center of the figure, an exemplary tab is shown on front, as at 52(*b*). Each tab has an elongated shape, such as elliptical, conical, or polygonal. Each tab has a length greater than the thickness of the cover itself and the thickness of the cap 9.

Figure 17:
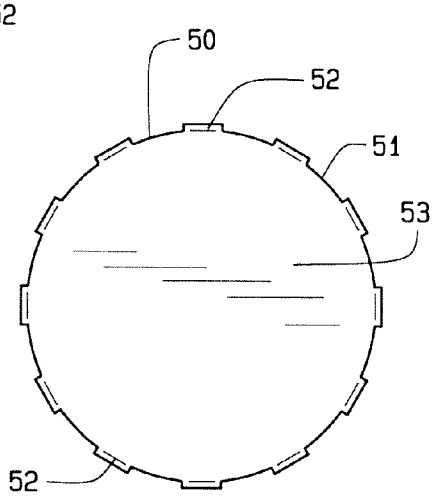
FIG. 17 is a top view of the cover of the alternate embodiment of FIG. 14.
Figure 18:
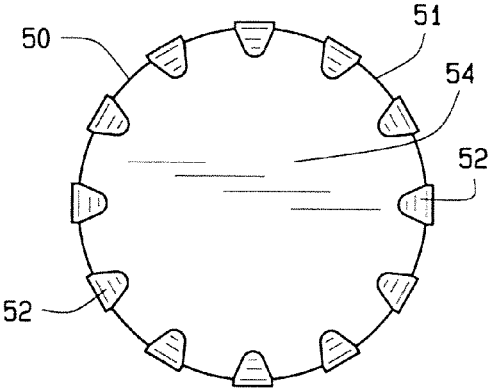
FIG. 18 is a bottom view of the cover of the alternate embodiment of FIG. 14.

From the top, the cover 50 has its round shape shown in FIG. 17 with the tabs 52 extending outwardly from the perimeter and below the cover. This view shows a top surface 53 of the cover. A user would see the top surface during and after installation of the cover upon a cap. The top surface may include various connecting or linking mechanisms for attaching a decoration, as at 14, to the cover and hence to the stopper at its cap. The connecting or linking mechanisms include hook and loop fastener as previously shown, magnetism, cooperating snap fittings as previously shown, threading, and the like. Opposite the top surface, the cover has its bottom surface 54 shown in FIG. 18, also generally round in shape. The bottom surface 54 has the tabs 52 generally approaching it. The narrow portion of the tabs, previously shown as 52(*b*), generally orients inwardly towards the bottom surface.

Figure 19:
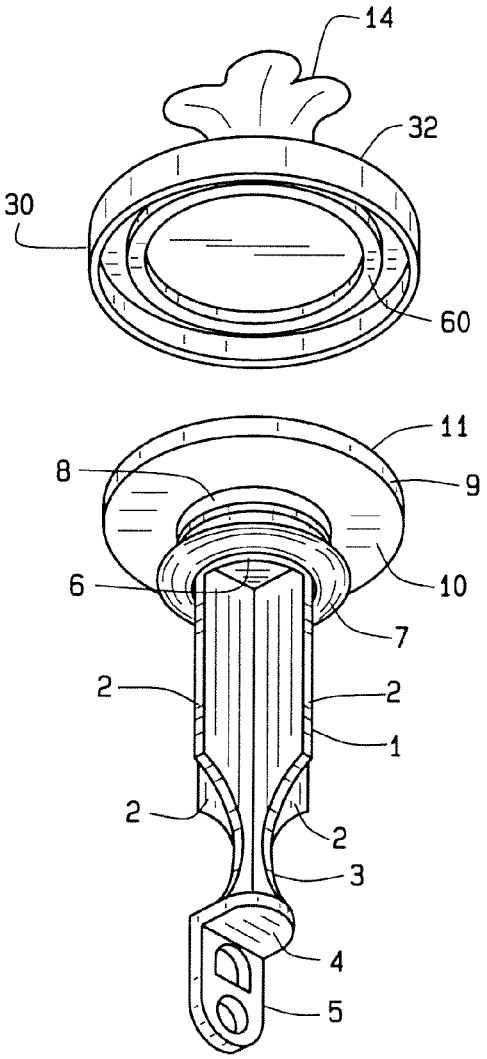
FIG. 19 describes an exploded bottom view of an alternate embodiment with a cover including a magnet.

FIG. 19 introduces an embodiment of the invention utilizing magnetism. This alternate embodiment has a stopper 1, or pop-up stopper, as before with its cap 9, generally round in shape. The cap has a ferrous material for this embodiment that includes a cover 30. This cover has a round shape, an upper surface 32, an opposite lower surface 37, and an optional lip 35 depending from the perimeter of the cover. Within the cover, generally proximate the upper surface, the cover includes an annular magnet as at 60 with an outer radius and an inner radius. The outer radius is from about 1% to about 20% greater than the inner radius. The magnet can be embedded into a channel in the upper surface through a snap fit, molded into the cover, adhered to the upper surface and like connections. The magnet then secures the cover to a ferrous cap 9 and receives a decoration 14 having at least a ferrous base to it on the upper surface. In the event that the cap 9 has a non-ferrous construction, the cover 30 may incorporate the various connecting methods and devices as previously described in the other embodiments.

Figure 20:
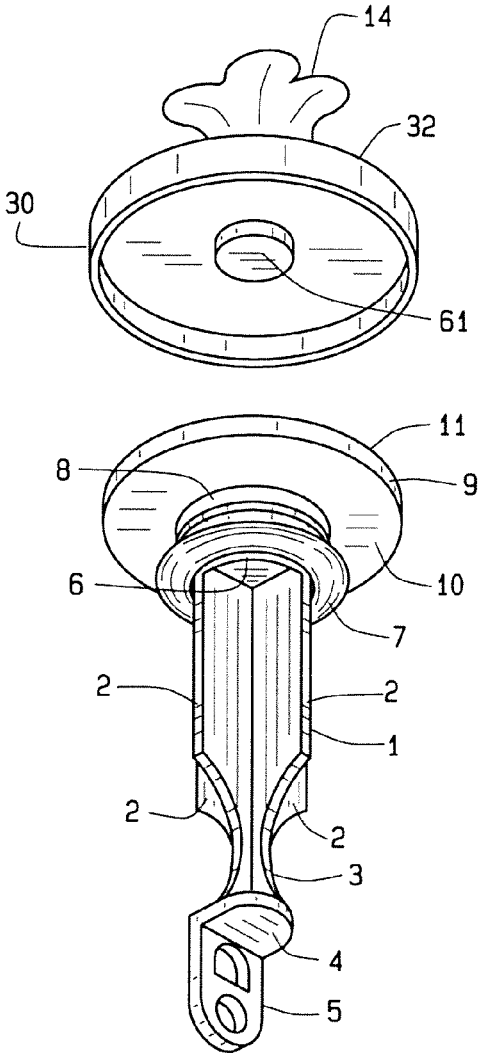
FIG. 20 describes an exploded bottom view of the alternate embodiment of FIG. 19 with a magnet centered in the cover; and, FIG. 21 describes an exploded bottom view of the alternate embodiment of FIG. 19 with magnetic feet beneath the cover.

An alternate embodiment of the magnet, as at 61, is shown in FIG. 20. This embodiment has the magnet 61 generally centered upon the upper surface 32 of the cover 30 and having a radius much less than the radius of the upper surface. This form of the magnet applies its magnetic force from the center of the cover. As above, the magnet can be embedded, molded, adhered, and like connected to the cover. The magnet operates to both secure the cover to the ferrous cap 9 and the decoration 14 to the cover opposite the cap. If the event the cap 9 is non-ferrous, the cover 30 may incorporate the various connecting methods and devices as previously described in the other embodiments.

Figure 21:
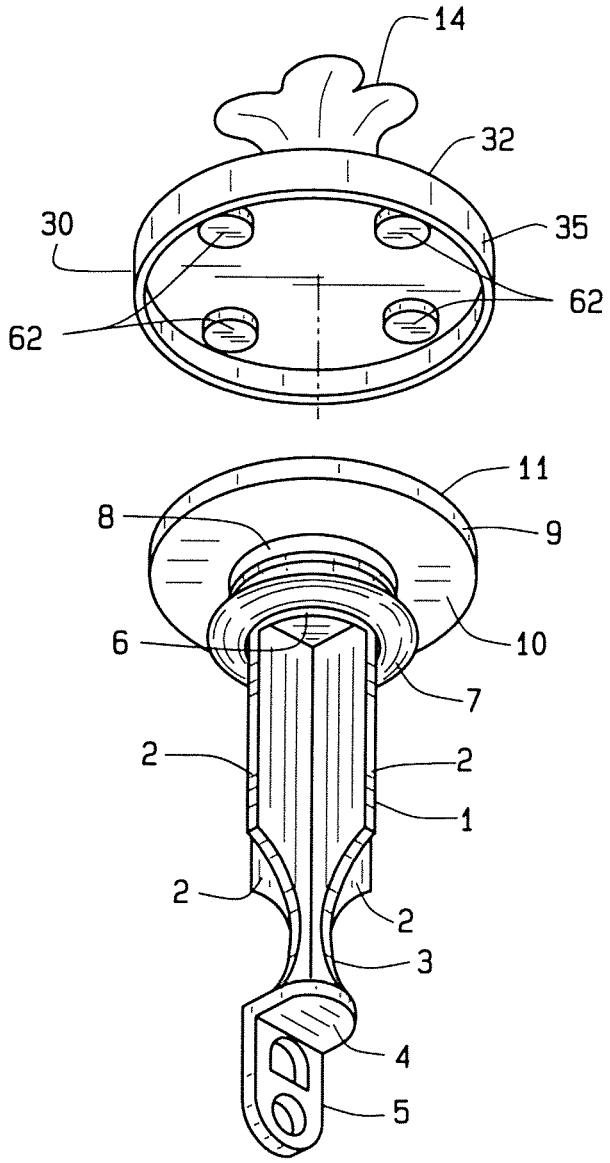

And, FIG. 21 shows a further alternate embodiment where a cover 30 secures to an existing stopper 1 with its round cap 9. The cap has a ferrous material for this embodiment to which the cover attracts. This cover has a round shape, an upper surface 32, an opposite lower surface 37, and an optional lip 35 depending from the perimeter of the cover. Upon or proximate the lower surface, the cover has a plurality of magnets 62. The magnets generally extend beneath the lower surface to provide passage for water to drain from beneath the cover. The magnets can be embedded into recesses in the lower surface through a snap fit, molded into the cover, adhered to the lower surface, and like connections. The magnets then secure the cover to a ferrous cap 9 and receives a decoration 14 having at least a ferrous base to it on the upper surface. In the event that the cap 9 has a non-ferrous construction, the cover 30 may incorporate the various connecting methods and devices as previously described in the other embodiments.

From the aforementioned description, a decorative attachment device has been described. The decorative attachment device is uniquely capable of securing a two or three dimensional object of sculpture, or decoration, upon an existing stopper for a bathroom or other sink. The decorative attachment device and its various components may be manufactured from many materials, including but not limited to, wood, steel, aluminum, polymers, such as nylon, polypropylene, polyvinyl chloride, high density polyethylene, polypropylene, ferrous and non-ferrous metals, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A device attaching a three dimensional decoration to a stopper, the stopper having an elongated body with two opposite ends, a plate upon one end, and a wall upon the plate, the device consisting of:

a continuous cap, having an upper surface and an opposite lower surface, a perimeter, said upper surface adapted to receive a three dimensional decoration and a lip depending from said perimeter and hanging beneath said upper surface;

said cap adapted to have a greater width than the width of the wall;

a centered cylindrical magnetic link within said lip of said cap and contiguously beneath said lower surface; and, said centered cylindrical magnetic link is adapted to releasably connect said cap to the plate wherein said link prevents inadvertent separation of said cap from the plate.

2. A device attaching a decoration to a drain consisting of:

a continuous cover, having an upper surface, an opposite lower surface, and a perimeter of said upper surface, said upper surface adapted to receive a decoration, and a lip depending from said perimeter and hanging beneath said perimeter of said upper surface;

at least one centered cylindrical magnet within said lip of said cover and connected beneath and contiguously joining to said lower surface, said at least one magnet having a thickness wherein said at least one magnet extends beneath said lower surface; and, wherein a user places said cover proximate a drain, said lower surface towards the drain and wherein said cover permits drainage of water beneath it.

* * * * *